US006125764A

United States Patent [19]

Kamdar

[11] Patent Number: 6,125,764

[45] Date of Patent: Oct. 3, 2000

[54] SIMPLIFIED TAILORED COMPOSITE ARCHITECTURE

[75] Inventor: Dipak S. Kamdar, Maple Grove, Minn.

[73] Assignee: Alliant Tech Systems Inc., Hopkins, Minn.

[21] Appl. No.: 09/160,952

[22] Filed: Sep. 25, 1998

[51] Int. Cl.[7] ..... F42B 14/00

[52] U.S. Cl. ..... 102/520; 102/517; 102/518; 102/521; 102/522; 102/523

[58] Field of Search ..... 102/517, 518, 102/520, 521, 522, 523

[56] References Cited

U.S. PATENT DOCUMENTS 5,789,699 8/1998 Stewart et al. ..... 102/521

*Primary Examiner*—Michael J. Carone
*Assistant Examiner*—Daniel J. Beitey
*Attorney, Agent, or Firm*—George A. Leone; Mark Goldberg

[57] ABSTRACT

A simplified tailored composite architecture for use in fabricating a composite sabot where the composite sabots are fabricated from a number of wedge kits. The resultant composite sabot includes a front scoop having a scoop angle. The simplified tailored composite architecture includes a panel adapted to be formed into a wedge kit. The panel has a number of plies of prepreg materials oriented in a number of different directions, where one of the number of different directions includes the direction of dominant homogeneous fiber orientation. A pattern within the panel includes selected prepreg segments rotated so that the direction of dominant homogeneous fiber orientation in the selected prepreg segments is aligned to be substantially parallel to the at least one dominant scoop fiber orientation when the panel is subsequently formed into a wedge kit.

21 Claims, 7 Drawing Sheets

SIMPLIFIED TAILORED COMPOSITE ARCHITECTURE

U.S. GOVERNMENT RIGHTS

The United States Government has certain rights to this invention under government contract number DAAE30-97-C-1006.

FIELD OF THE INVENTION

The present invention is generally related to sabots, and more particularly to a to composite sabot with a simplified tailored composite architecture.

BACKGROUND OF THE INVENTION

In military ordnance arts, carriers for projectiles, known as sabots, have been used to facilitate the use of a variety of munitions while engaging in military operations.

In general, a sabot is a lightweight carrier for a projectile that permits the firing of a variety of projectiles of a smaller caliber within a larger caliber weapon. A sabot provides structural support to a flight projectile within a gun tube under extremely high loads. Without adequate support from a sabot, a projectile may break up into many pieces when fired.

A sabot fills the bore of the gun tube while encasing the projectile to permit uniform and smooth firing of the weapon. The projectile is centrally located within the sabot that is generally symmetrical. After firing, the sabot and projectile clear the bore of the gun tube and the sabot is normally discarded some distance from the gun tube while the projectile continues toward the target.

One method for discarding a sabot is to form a scoop onto the sabot. After the sabot and projectile clear the weapon bore, the scoop gathers, or "scoops," air particles as it is moving forward. The air pressure on the front scoop lifts the sabot from the projectile and thus the sabot is removed from the projectile in flight, allowing the projectile to continue towards its target.

For a kinetic energy projectile supported by a sabot to have a high muzzle velocity, the parasitic weight around the flight projectile must be substantially minimized. Part of this objective has been achieved through the use of advanced lightweight graphite epoxy prepreg material for sabots. Prepreg is the material resulting from impregnating fiber reinforcements with a formulated resin. These advanced composite materials offer many advantages over conventional steel and aluminum since parts fabricated from prepreg materials are generally stronger, lighter and stiffer than metals. They also provide greater resistance to fatigue, creep, wear and corrosion than metals. Composite parts made from prepreg have very high strength in the direction of the fibers and very poor strength in other directions.

A composite sabot is typically fabricated from prepreg panels having plies oriented in different directions. A sabot's weight is substantially governed by its stiffness and strength in the axial direction since most of the loading is in axial direction. High axial strength and stiffness are often achieved at the expense of the stiffness in the radial direction.

In use, as a flight projectile travels down the flexible gun tube, it encounters significant lateral loads, called balloting loads. As the projectile bounces in the tube, the front bourrlet, or the scoop of sabot, undergoes deformation proportional to its radial stiffness. As the scoop bends under the application of lateral loads, the penetrator also bends and moves away from the tube centerline. The perturbations in the gun tube may result in the penetrator exhibiting a high yaw rate at muzzle exit. A high yaw rate causes poor target impact dispersion or accuracy. It is known that a stiffer front scoop improves the accuracy of projectile by reducing bending of the scoop.

Aluminum sabots maintain acceptable radial stiffness in the front scoop. Unfortunately, aluminum sabots suffer from the other drawbacks of metals noted above. Conversely, although the use of composite material for sabots has many advantages as listed above, prior known composite sabots exhibit poor radial stiffness as compared to aluminum sabots. Certain projectiles with aluminum sabots have proven very accurate. In contrast, a similar projectile with a conventional composite sabot does not compare favorably with the accuracy of a comparable aluminum sabot. It is believed that, since both projectiles use substantially the same kinetic penetrator, lower radial stiffness inherent in the conventional composite sabot contributes to the poor accuracy of the projectile using the conventional composite sabot.

Additionally, sabots are generally made in three symmetrical segments to facilitate smooth discard upon exit from the gun. Typically, each segment, or petal, spans 120 degrees of the front circumference of the intact sabot. The overall advantage of a three-petal sabot design is that the sabot is released more quickly, thereby reducing lateral disturbance to the flight projectile, thereby increasing accuracy.

Further, for optimal technical and marketplace performance, there are several other objectives to be considered when designing a sabot. For example, the sabot must be easy to build and cost effective. Further, the sabot must be lightweight, yet rigid and strong. Composite sabots are effective in obtaining most of these objectives; however, some aspects of rigidity and strength, in particular, radial strength, elude composite sabots.

Prior art weight reductions of composite sabots are made by aligning the prepreg fibers in the axial plane of the sabot which matches the greatest load directions generated during the projectile's travel down the weapon bore. This method of aligning all the fibers in the same direction throughout the sabot, to match the greatest loads, is commonly referred to as homogeneous composite architecture.

FIG. 4 shows an example of a homogeneous composite architecture 400 of the prior art developed by Alliant Techsystems Inc. used to make homogeneous architecture composite sabots. Illustrated in FIG. 4 is a top view of a homogenous layup 410 using homogeneous composite architecture 400. Homogeneous layup 410 comprises a panel including a plurality of homogeneous prepreg plies 412 stacked on top of each other. Further, homogeneous layup 410 is overlaid with a homogeneous layup pattern 408. Homogeneous layup pattern 408 arranges a plurality of homogeneous prepreg segments 450 Within homogeneous layup 410.

Each homogeneous prepreg ply 412 has a different fiber orientation, resulting in homogeneous fiber orientations 420. A first homogeneous fiber orientation 422 and a second homogeneous fiber orientation 424 are both oriented at 0 degrees with respect to a homogeneous sabot axial direction 440. A third homogeneous fiber orientation 426 and a fourth homogeneous fiber orientation 428 are not aligned with the homogeneous sabot axial direction 440, nor are they aligned with each other.

First homogeneous fiber orientation 422 and second homogeneous fiber orientation 424 create a dominant homogeneous fiber orientation 430 because they are aligned in the same direction. Dominant homogeneous fiber orientation 430 represents the direction in which homogeneous layup 410 has the most strength and rigidity. In this case, dominant homogeneous fiber orientation 430 aligns along homogeneous sabot axial direction 440.

All of the homogeneous prepreg segments 450 are also aligned along the homogeneous sabot axial direction 440. Hence, all of the homogenous prepreg segments 450 have the highest strength and rigidity along the homogeneous sabot axial direction 440. As a result, homogeneous composite architecture 400 provides a sabot with high axial strength and rigidity, but does so at the expense of lower radial strength and rigidity.

Lowering radial strength leads to poor accuracy, making homogenous composite architecture sabots less desirable than aluminum sabots. Additionally, as mentioned, the inadequate radial rigidity of the existing composite sabot scoops can lead to higher parasitic weight and lower impact velocity.

Another prior art technique called "tailored architecture" sought to overcome the problems with homogeneity by individually orienting each prepreg segment along the direction of dominant homogeneous fiber orientation to supply each part of the sabot with the required strength. Conventional tailored architecture uses a different layup for each prepreg segment. Unfortunately, using multiple layups creates a great deal of waste during manufacturing because only a few segments will be cut from each layup. Moreover, bookkeeping for all the different layups, orientations, and segments quickly becomes very difficult as the number of segments increases.

If segments are improperly aligned during fabrication, the result could be structural failure of the sabot. Sabot failure can cause a multitude of problems from weapon jams to misfires. Moreover, because advanced lightweight graphite epoxy materials are relatively expensive, the high cost of waste makes using prior art tailored architecture prohibitive.

In contrast to the prior art, the invention disclosed herein provides a simplified tailored architecture for use in fabricating composite sabots. The unique simplified architecture of the invention uses homogeneous composite ply panels to reduce cost and reduce the chance of misalignment of some critical segments during fabrication of kits. The simplified tailor architecture of the invention maintains high axial strength and stiffness necessary for resisting axial loads while providing high radial stiffness and strength in the front scoop and the rear bourrelet of the sabot.

Further in contrast to the prior art, the simplified tailored architecture of the invention features rotating the prepreg segments that comprise the front scoop and rear bulkhead in the direction of dominant homogeneous fiber orientation on the same layup that includes other segments aligned for high axial strength. Rotation of these segments does not affect kit or sabot segment molding processes. Orienting fibers in front scoop results in a significantly stiffer scoop to improve the yaw rate at muzzle exit.

Composite sabots built in accordance with the present invention have high scoop strength so that the sabot can be discarded faster. A stiffer front scoop and a faster discard rate yield a composite sabot having accuracy approaching that of an aluminum sabot, but without the drawbacks of using aluminum. Thus, the simplified tailored architecture of the invention preserves advantages of composite materials without adversely impacting the manufacturing process or cost of a sabot.

SUMMARY OF THE INVENTION

The invention provides a simplified tailored composite architecture for use in fabricating a composite sabot where the composite sabots are fabricated from a plurality of wedge kits. The resultant composite sabot includes a front scoop having at least one dominant scoop fiber orientation. The simplified tailored composite architecture comprises a panel adapted to be formed into a wedge kit. The panel has a plurality of plies of prepreg materials oriented in a plurality of different directions, wherein one of the plurality of different directions includes the direction of dominant homogeneous fiber orientation. A pattern within the panel includes selected prepreg segments rotated so that the direction of dominant homogeneous fiber orientation in the selected prepreg segments is aligned to be substantially parallel to the at least one dominant scoop fiber orientation when the panel is subsequently formed into a wedge kit.

In another aspect, the invention teaches a method of fabricating a composite sabot from a simplified tailored architecture. The sabot includes a sabot body integrally connected to a front scoop and a rear bourrelet, wherein the front scoop extends from the sabot body at a predetermined angle. The sabot body and both scoops are segmented into three sabot petals, wherein the sabot petals have a cross-section spanning a predetermined arc, in one example a 120-degree cross-section, and the sabot petals are radially mounted around a penetrator. A plurality of radially molded wedge kits comprises each sabot petal to form the predetermined cross-section of the sabot petal. In turn, a plurality of molded prepreg segments comprises each wedge kit. Prepreg segments for two wedge kits are cut from a single layup consisting of prepreg material, wherein the layup has a direction of dominant homogeneous fiber orientation. The simplified tailored architecture layup pattern aligns the body segments to match the orientation of the dominant fiber direction and rotates the rear bourrelet, the front scoop segments, or both, by the predetermined angle relative to the dominant fiber direction, to parallel radial loads on the scoops. A plurality of weld points are used to weld the prepreg segments before the segments are cut from the layup to facilitate handling of the prepreg segments. A plurality of square indexing points and a plurality of triangular indexing points mark the prepreg segments to facilitate proper assembly of the prepreg segments into wedge kits.

Other objects, features and advantages of the present invention will become apparent to those skilled in the art through the description of the preferred embodiment, claims and drawings wherein like numerals refer to like elements.

DETAILED DESCRIPTION OF THE INVENTION

Figure 1:
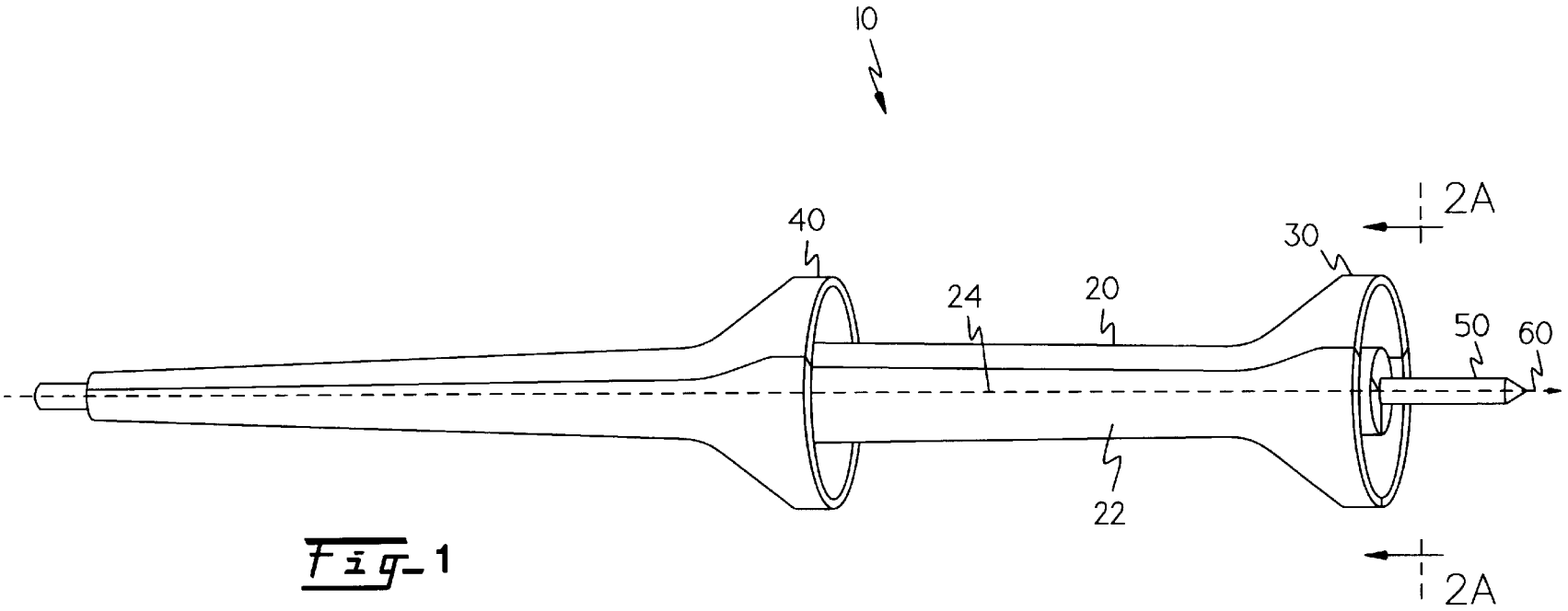
FIG. 1 is a three dimensional perspective view of a projectile with a composite sabot of the invention.

Illustrated in FIG. 1 is a three dimensional perspective view of a composite sabot 10 in accordance with the present invention. Composite sabot 10 has a sabot body 20, a front scoop 30, and a rear bourrelet 40. Composite sabot 10 is axially divided along three petal divisions 24 into three sabot petals 22. Sabot petals 22 are radially mounted around a penetrator 50 and a sabot axial direction 60. Illustrated in FIG. 2A is a front view of composite sabot 10 of the present invention taken generally along a front view as indicated by the line 2A—2A of FIG. 1. This view shows front scoop 30 radially divided along three petal divisions 24 into three sabot petals 22.

Each sabot petal 22 has a predetermined radial arc angle 200. In one useful embodiment, the predetermined radial arc angle 200 is about 120 degrees. Fully assembled, the three 120-degree sabot petals 22 encompass penetrator 50 to form the entire 360-degree cross-section of composite sabot 10. It will be understood that values with respect to the various features of the invention recited herein are intended only by way of example and that the invention is not so limited.

Figure 2B:
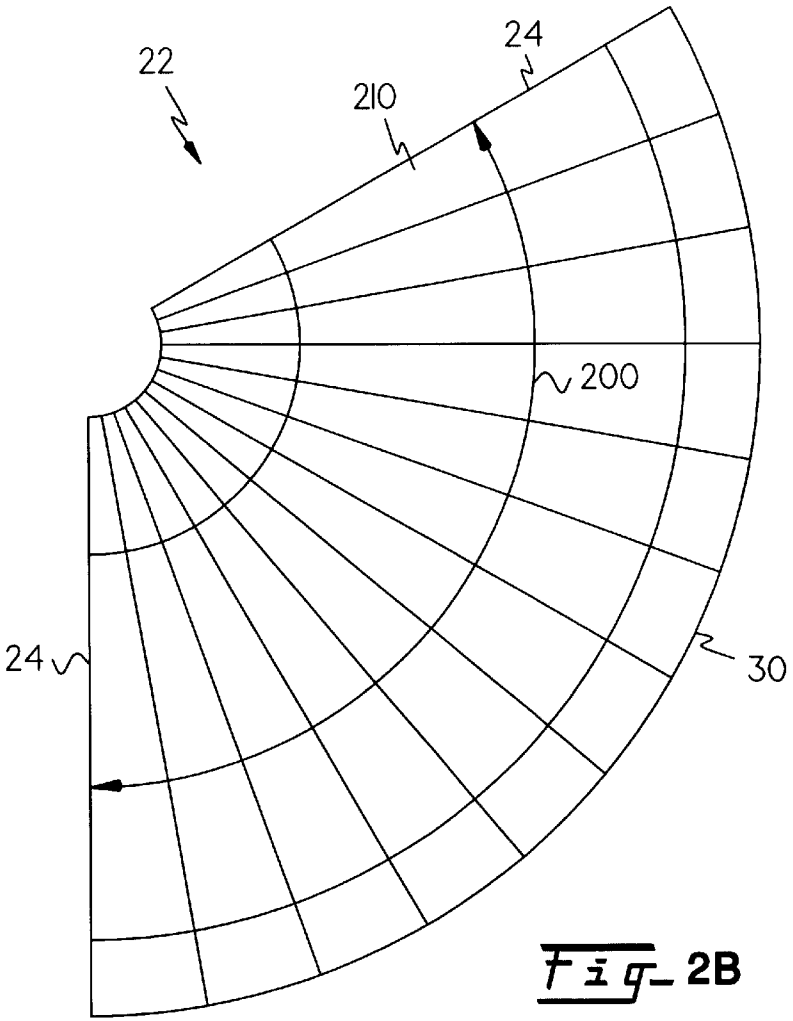
FIG. 2B is a detailed front view of a sabot petal of the invention.
Figure 2A:
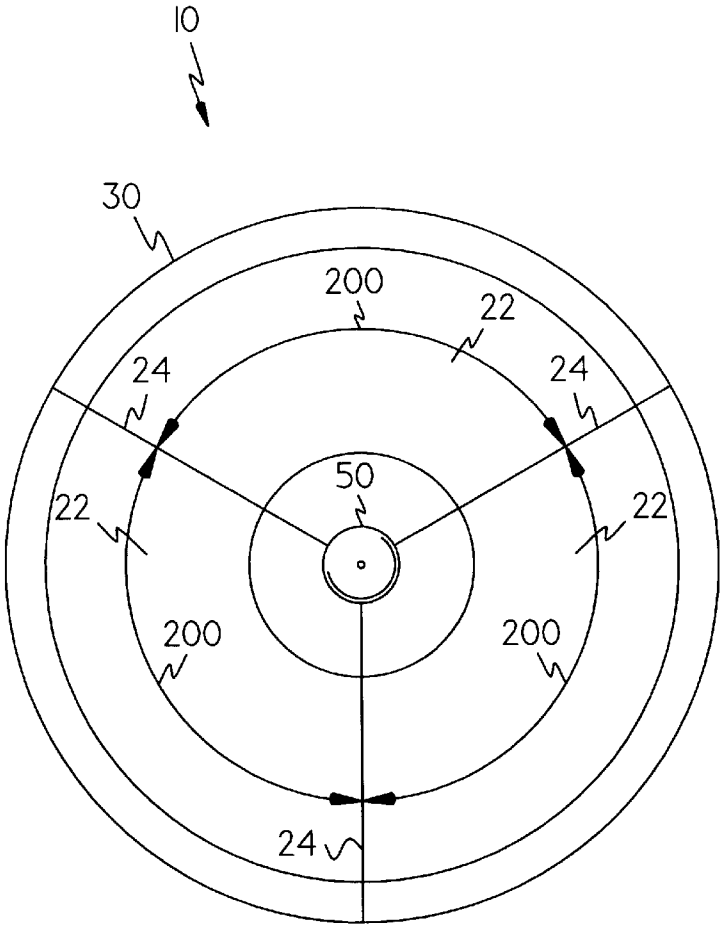
FIG. 2A is a front view of a composite sabot of the invention.

Illustrated in FIG. 2B is a detailed front view of sabot petal 22 of the present invention. In this example, sabot petal 22 has radial arc angle 200 of 120 degrees spanning from one petal division 24 to another petal division 24. Front scoop 30 is nominally radially divided by a plurality of wedge kits 210 that are radially mounted to each other around penetrator 50 to comprise sabot petal 22.

Additionally, wedge kits 210 extend the entire axial length of sabot petal 22. As shown in this example, each wedge kit 210 spans 5 degrees and each sabot petal 22 spans 120 degrees, so approximately twenty-four wedge kits 210 are necessary to assemble one sabot petal 22. Those skilled in the art will recognize that wedge kits and sabot petals may span various arcs and are not limited by the example herein described.

Figure 3A:
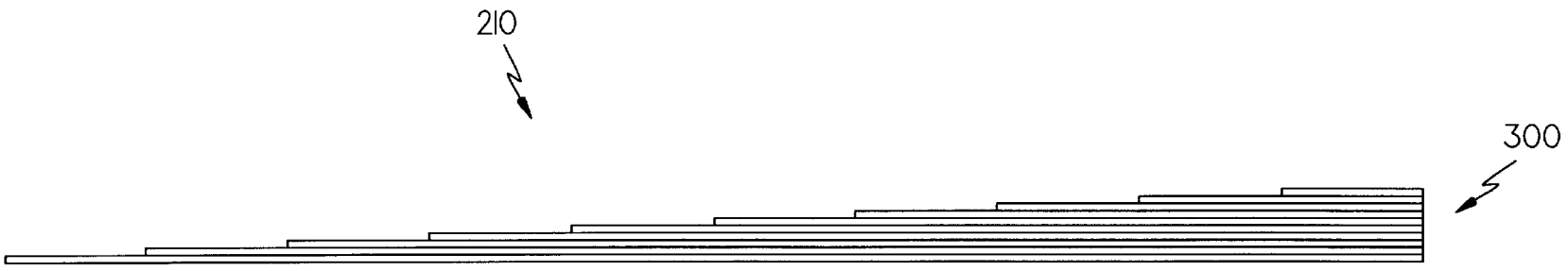
FIG. 3A is a detailed front view of a wedge kit of the invention.

Illustrated in FIG. 3A is a detailed front view of wedge kit 210 of the present invention. Wedge kit 210 is comprised of a plurality of prepreg segments 300, wherein prepreg segments 300 are stacked to compose the wedge kit 210.

Figure 3B:
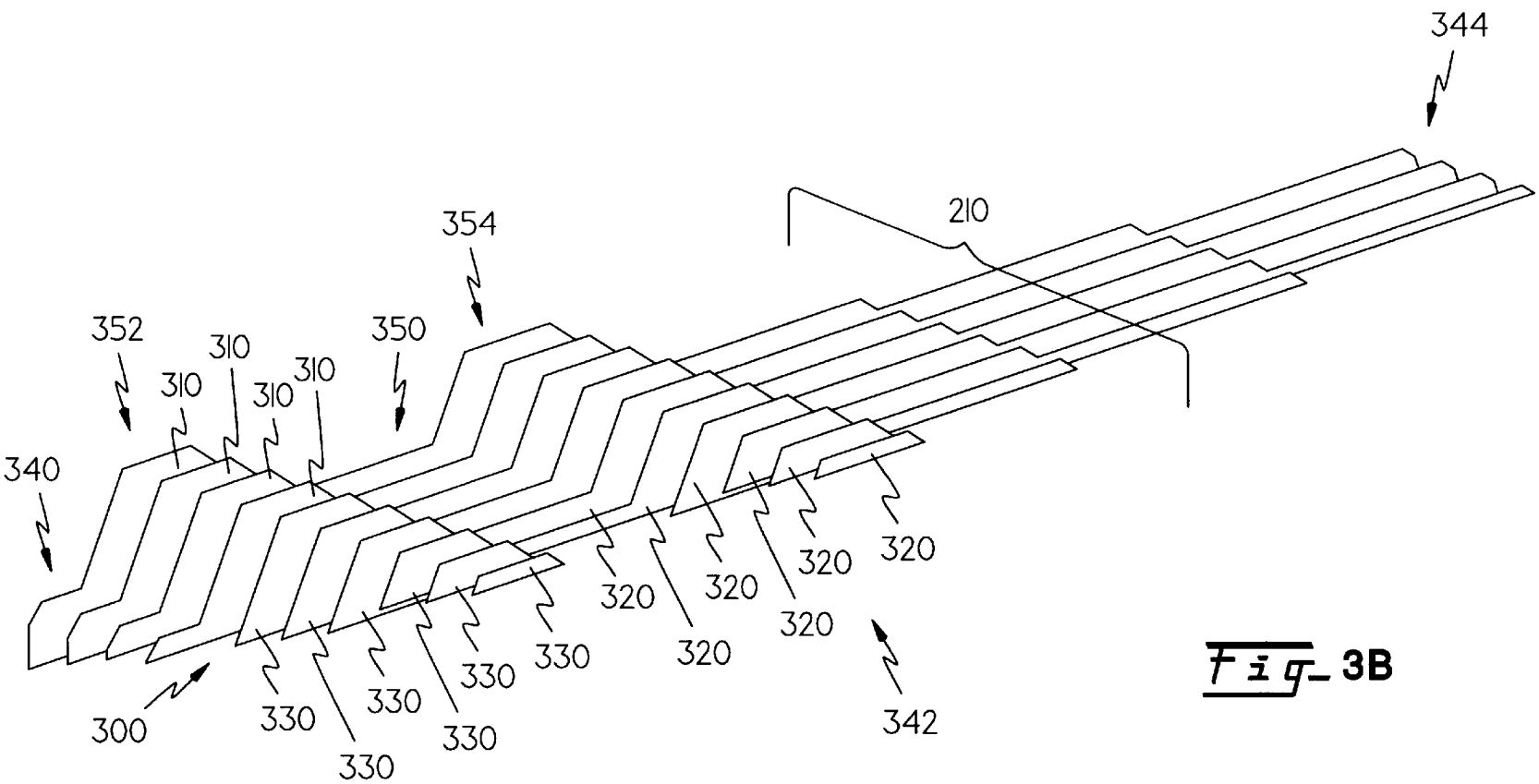
FIG. 3B is an exploded side view of a wedge kit of the invention.
Figure 4:
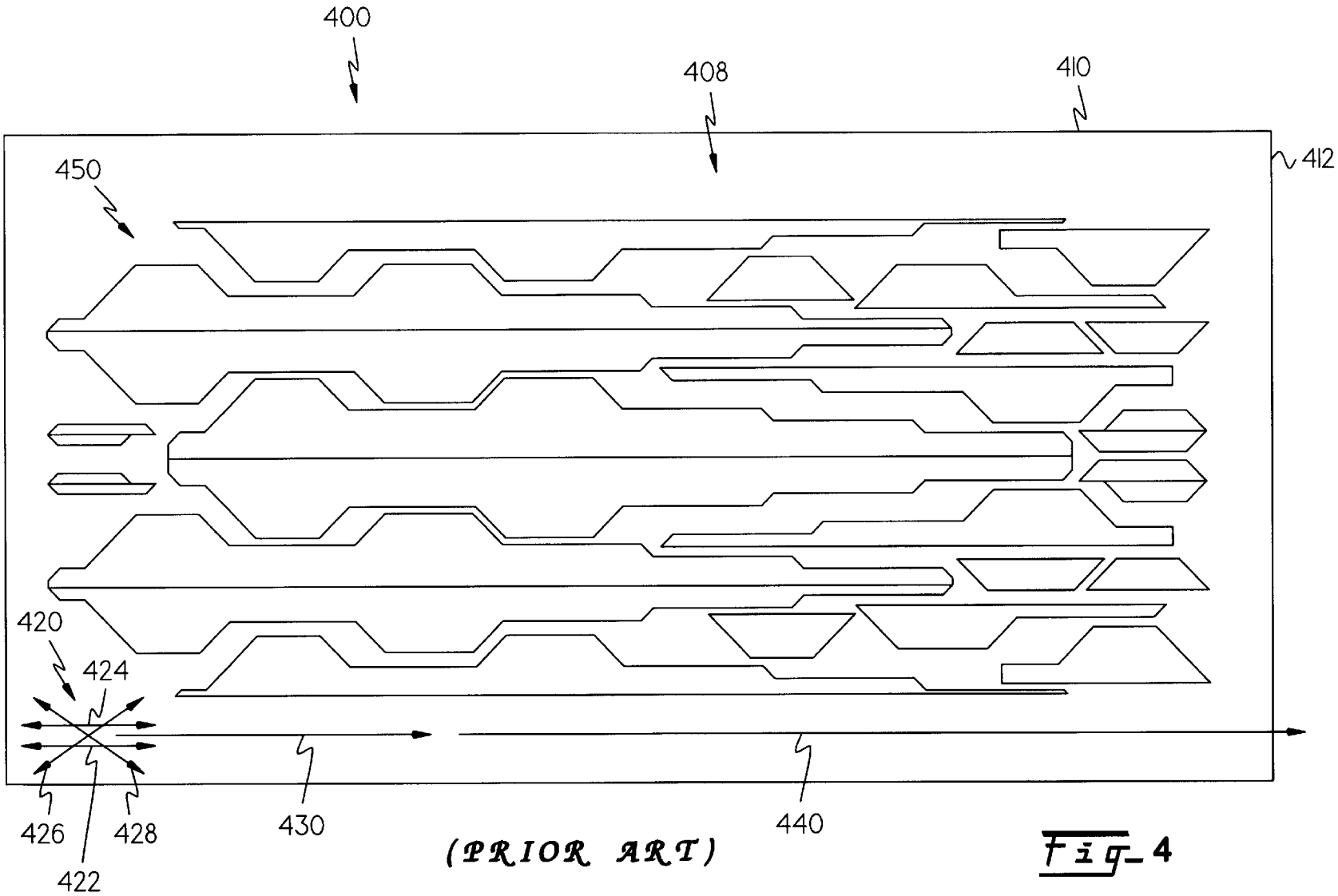
FIG. 4 (PRIOR ART)
FIG. 4 is a top view of a homogeneous composite architecture of the prior art.

Illustrated in FIG. 3B is an exploded side view of wedge kit 210 of the present invention. Wedge kit 210 is made up of prepreg segments 300, wherein prepreg segments 300 comprise a plurality of body segments 310, a plurality of front scoop segments 330, and a plurality of rear bourrelet segments 320. Wedge kit 210 extends the length of composite sabot 10 (shown in FIG. 1).

Wedge kit 210 has a front end 340, a mid-section 342, and back end 344, wherein front end 340 corresponds to the front of composite sabot 10. Body segments 310 extend from front end 340 to back end 344 and compose a body portion 350 and parts of both a front scoop portion 352 and a rear bourrelet portion 354.

Front scoop segments 330 are located between front end 340 and mid-section 342 and compose front scoop portion 352 of wedge kit 210. Rear bourrelet segments 320 are located near mid-section 342 and compose rear bourrelet portion 354 of wedge kit 210.

Figure 5:
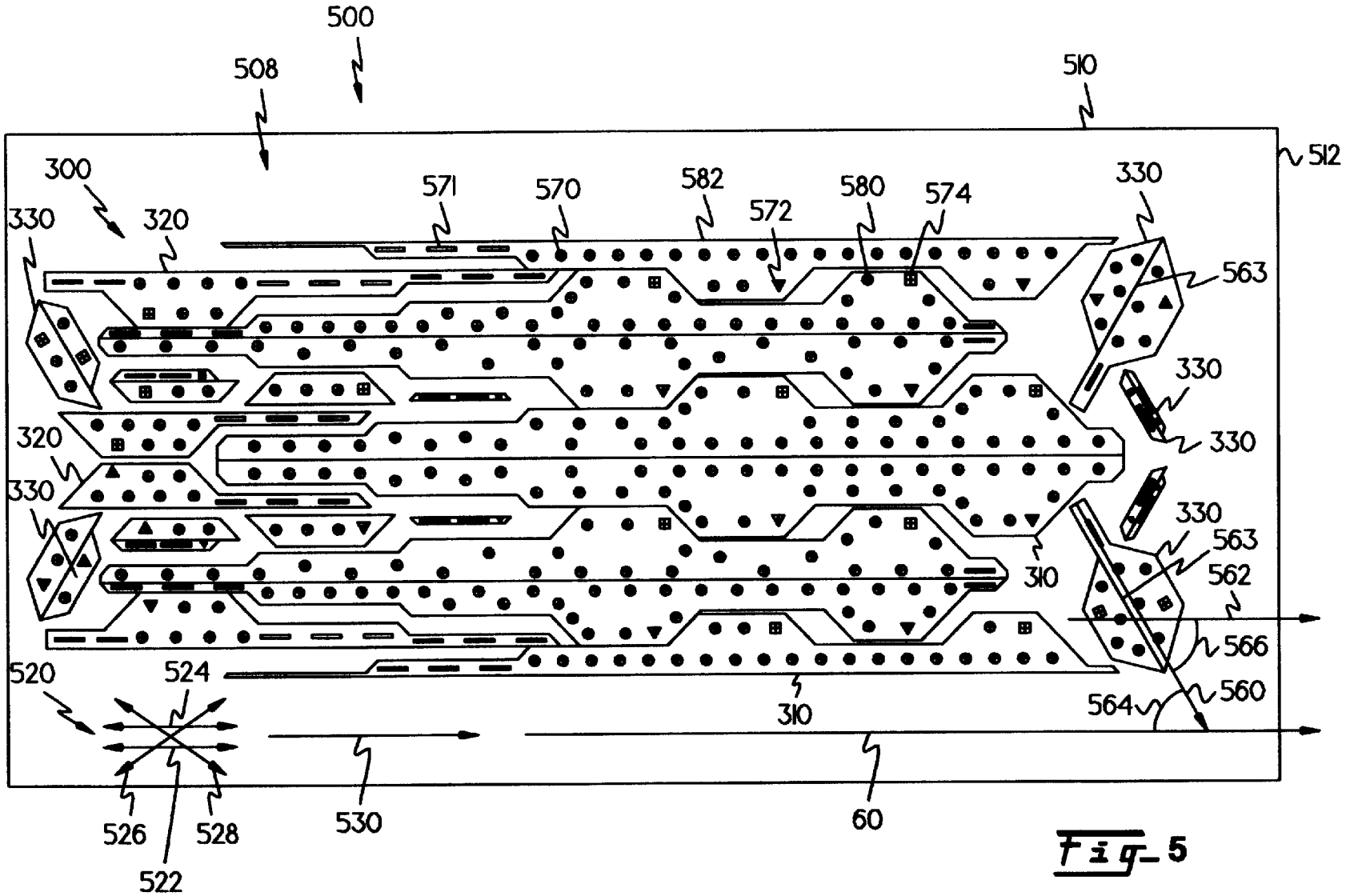
FIG. 5 is a top view of one example of a simplified tailored composite architecture of the invention.

Now referring to FIG. 5, illustrated in FIG. 5 is a top view of a layup 510 using one example of a simplified tailored composite architecture 500, in accordance with the present invention. Simplified tailored composite architecture 500 has a layup 510, wherein layup 510 comprises a plurality of prepreg plies 512. Prepreg plies 512 are stacked on top of each other and welded together at a plurality of circular weld points 570, a plurality of rectangular weld points 571, a plurality of triangular indexing weld points 572, and a plurality of square indexing weld points 574. Further, layup 510 is overlaid with a layup pattern 508, wherein layup pattern 508 advantageously arranges prepreg segments 300 within layup 510. Those skilled in the art will recognize that the shapes of the indexing weld points are not limited by the example shown, but may be any shape, pattern, numbering, lettering or indicia.

In this example embodiment of the present invention, layup 510 has a plurality of prepreg plies 512 with a plurality of corresponding fiber orientations 520. In one useful embodiment four plies are used with four fiber orientations. A first fiber orientation 522 and a second fiber orientation 524 are both oriented at 0 degrees with respect to sabot axial direction 60. A third fiber orientation 526 and a fourth fiber orientation 528 are not aligned with sabot axial direction 60, nor are they aligned with each other. Those skilled in the art will appreciate that the invention is not limited to the example hereinabove, and that any useful number of fiber orientations and/or plies may be employed.

First fiber orientation 522 and second fiber orientation 524 create a direction of dominant homogeneous fiber orientation 530 because they are aligned in the same direction. Direction of dominant homogeneous fiber orientation 530 represents the direction that layup 510 has the most strength and rigidity. In this case, direction of dominant homogeneous fiber orientation 530 is aligned along sabot axial direction 60.

Body segments 310 and rear bourrelet segments 320 are also aligned along the sabot axial direction 60. Hence, body segments 310 and rear bourrelet segments 320 have the most strength along sabot axial direction 60. As a result, simplified tailored composite architecture 500 advantageously gives composite sabot 10 (shown in FIG. 6) axial strength and rigidity along sabot body 20 (shown in FIG. 6), where axial strength and rigidity are required most.

However, before being cut from layup 510, front scoop segments 330 are not aligned along the sabot axial direction 60. Instead, front scoop segments 330 are aligned along a front scoop alignment direction 560, wherein front scoop alignment direction 560 is advantageously rotated by a first rotation angle 564 from the sabot axial direction 60. Although first rotation angle 564 can be any angle within a wide range of angles, in this example of the present invention, first rotation angle 564 is equal to 60 degrees to reinforce front scoop 20. In general, first rotation angle 564 and second rotation angle 566 may be any desired angle and may be different from each other depending upon the application.

Before being cut from layup 510, front scoop segments 330 have a dominant scoop fiber orientation 562 that extends at a second rotation angle 566 from front scoop alignment direction 560 and extends parallel to sabot axial direction 60. Note that, in the example shown, two similar front scoop segments 330 abut each other along a cutting line 563. This is done in order to reduce waste during cutting. Other segments are similarly laid out. Since front scoop alignment direction 560 bisects the parallel lines of dominant scoop fiber orientation 562 and sabot axial direction 60, second rotation angle 566 is equal to first rotation angle 564, or in this example of the present invention, 60 degrees.

Figure 6:
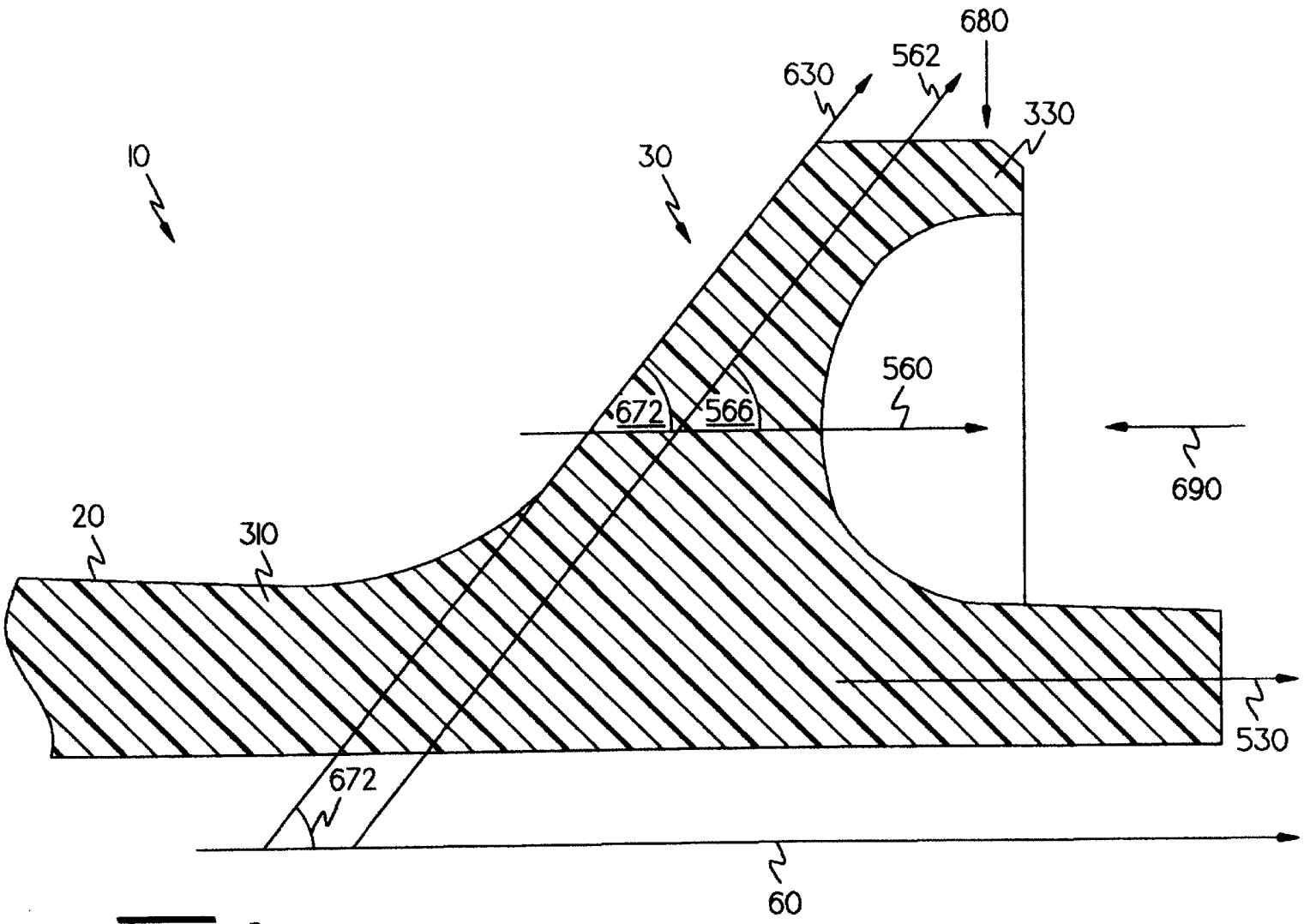
FIG. 6 is a partial cross-sectional side view of a composite sabot using one example of a simplified tailored composite architecture of the invention.

Illustrated in FIG. 6 is a partial cross-sectional side view of composite sabot 10 using simplified architecture 500 of the invention. FIG. 6 shows front scoop segment 330 and body segment 310 after being cut from layup 510 and incorporated into composite sabot 10. Front scoop segment 330 is molded and machined into a scoop shape and rotated after being cut from layup 510 so that front scoop alignment direction 560 runs parallel to sabot axial direction 60.

Front scoop 30 extends along a front scoop angle 672 from sabot axial direction 60. In this example of the present invention, front scoop angle 672 is about 60 degrees, but may be any suitable angle for forming a front scoop. For example, front scoop angle 672 may be an angle in the range of 90 degrees to 45 degrees in relation to the axis of sabot body 20. In this example of the present invention, front scoop radial direction 680 is transverse to front scoop alignment direction 560. Dominant scoop fiber orientation 562 extends at about 60 degrees from front scoop alignment direction 560.

Since strength and rigidity are located along the direction of the dominant scoop fiber orientation 562, the simplified tailored composite architecture 500 advantageously gives front scoop 30 radial strength and rigidity along front scoop radial direction 680 at a predetermined angle selected to increase radial strength. The dominant scoop fiber orientation may be any angle that increases radial strength. For example, the dominant scoop fiber orientation 562 may be an angle in the range of 90 degrees to 45 degrees from sabot body 20. Front scoop 30 thereby has a dominant scoop fiber orientation 562 to counter radial forces directed against the front scoop 30. At the same time, sabot body 20 has direction of dominant homogeneous fiber orientation 530 to counter axial forces along axial direction 60.

Referring now again to FIG. 5, layup 510 has layup pattern 508 that advantageously arranges prepreg segments 300 so that two substantially identical wedge kits 210 (shown in FIG. 3A) can be assembled from prepreg segments 300. Thus, prepreg segments 300 are divided into a plurality of left prepreg segments 580 and a plurality of right prepreg segments 582. Left prepreg segments 580 are marked with square indexing points 574, but not triangular indexing points 572 and right prepreg segments 582 are marked with triangular indexing points 572, but not square indexing points 574. After being cut from layup 510, prepreg segments 300 are separated into left prepreg segments 580 and right prepreg segments 582 according to whether prepreg segments 300 have square indexing points 574 or triangular indexing points 572.

Additionally, as stated hereinabove, prepreg segments 300 are welded together at circular weld points 570, rectangular weld points 571, triangular indexing points 572, and square indexing points 574 to advantageously prevent prepreg segments 300 from being mishandled after being removed from the layup 510.

The simplified tailored composite architecture of the invention may be advantageously employed in a method for making a composite sabot wedge kit. A first step of the method includes patterning a panel adapted to be formed into a wedge kit, the panel having a plurality of plies of prepreg materials oriented in a plurality of different directions, wherein one of the plurality of different directions includes the direction of dominant homogeneous fiber orientation. A next step includes rotating a plurality of predetermined prepreg segments within the patterned panel so that the direction of dominant homogeneous fiber orientation in the selected plurality of prepreg segments is aligned to be substantially parallel to the at least one dominant scoop fiber orientation when the panel is subsequently formed into a wedge kit. Another step includes cutting the patterned panel to yield a plurality of wedge kit segments. At least one wedge kit is formed from the plurality of wedge kit segments.

In one example, the step of patterning a panel adapted to be formed into a wedge kit further includes the steps of patterning a layup pattern onto the panel, and segmenting the layup pattern into a plurality of body segments, a plurality of rear bourrelet segments, and a plurality of front scoop segments.

In another example, the step of patterning includes the step of rotating the front scoop segments with respect to the direction of dominant homogeneous fiber orientation. In a more preferred example the step of patterning includes the step of rotating the front scoop segments to a predetermined angle with respect to the direction of dominant homogeneous fiber orientation.

In another example, the step of patterning includes the step of rotating the rear bourrelet segments with respect to the direction of dominant homogeneous fiber orientation.

In another example, the step of patterning includes the step of rotating the front scoop segments and the rear bourrelet segments with respect to the direction of dominant homogeneous fiber orientation.

In one embodiment, the step of patterning further advantageously includes the steps of:

a) marking a plurality of circular weld points onto the panel to fix the prepreg segments after being cut from the layup;

b) marking a plurality of rectangular weld points onto the panel to fix the prepreg segments after being cut from the layup;

c) marking a plurality of triangular indexing points onto the panel for identifying right prepreg segments; and d) marking a plurality of square indexing points onto the panel for identifying left prepreg segments.

The invention has been described herein in considerable detail in order to comply with the Patent Statutes and to provide those skilled in the art with the information needed to apply the novel principles of the present invention, and to construct and use such exemplary and specialized components as are required. However, it is to be understood that the invention may be carried out by specifically different equipment and devices, and that various modifications, both as to the equipment details and operating procedures, may be accomplished without departing from the true spirit and scope of the present invention.

More specifically, layup pattern 508 for simplified tailored composite architecture 500 of the present invention may be a wide variety of other patterns beyond layup pattern 508. Simplified tailored composite architecture 500 may have either front scoop segments 330, rear bourrelet segments 320, or any combination thereof rotated on layup 510 to serve the intended function and accommodate manufacturing processing to achieve the integral structure as indicated herein.

Further, materials for layup 510 may be chosen from a wide array of materials to serve the intended purpose. The material may be selected from a wide array of fibrous or composite materials or epoxy/resin systems including carbon, glass, or equivalent materials to serve the intended function and accommodate manufacturing processing to achieve the integral structure as indicated herein. Layup 510 may be made of any number of prepreg plies 512 and layup 510 may also have any number of fiber orientations 520 or any number of prepreg segments 300.

For example, materials for layup 510 may include a continuous fiber/epoxy system, a thermoset fiber/epoxy system, a thermoplastic fiber/epoxy system, a continuous thermoset fiber/epoxy system, a continuous thermoplastic fiber/epoxy system, a thermoplastic fiber/resin system, a continuous thermoset fiber/resin system, and a continuous thermoplastic fiber/resin system.

Still further, first rotation angle 564, second rotation angle 566, and front scoop angle 672 may have many possible configurations to serve the intended function and accommodate manufacturing processing to achieve the integral structure as indicated herein. These and other modifications are all intended to be within the true spirit and scope of the present invention.

What is claimed is:

1. A simplified tailored composite architecture for use in fabricating a composite sabot, the composite sabot being fabricated from a plurality of wedge kits, wherein the composite sabot includes a front scoop having at least one dominant scoop fiber orientation, the simplified tailored composite architecture comprising:

a) a panel adapted to be formed into a wedge kit, the panel having a plurality of plies of prepreg materials oriented in a plurality of different directions, wherein one of the plurality of different directions includes a direction of dominant homogeneous fiber orientation; and b) a pattern within the panel including selected prepreg segments rotated so that the direction of dominant homogeneous fiber orientation in the selected prepreg segments is aligned to be substantially parallel to the at least one dominant scoop fiber orientation when the panel is subsequently formed into a wedge kit.

2. The simplified tailored composite architecture of claim 1 wherein the panel further comprises a plurality of body segments, a plurality of rear bourrelet segments, and a plurality of front scoop segments.

3. The simplified tailored composite architecture of claim 2 wherein the front scoop segments are rotated by at least 45 degrees with respect to the direction of dominant homogeneous fiber orientation.

4. The simplified tailored composite architecture of claim 2 wherein the front scoop segments are rotated by at least 60 degrees with respect to the direction of dominant homogeneous fiber orientation.

5. The simplified tailored composite architecture of claim 2 wherein the rear bourrelet segments are aligned along the direction of dominant homogeneous fiber orientation.

6. The simplified tailored composite architecture of claim 2 wherein the pattern further comprises a plurality of indicia impressed on the prepreg segments.

7. A method for making a composite sabot wedge kit from a simplified tailored composite architecture, wherein the composite sabot includes at least one dominant scoop fiber orientation, the method comprising:

a) patterning a panel adapted to be formed into a wedge kit, the panel having a plurality of plies of prepreg materials oriented in a plurality of different directions, wherein one of the plurality of different directions includes the direction of dominant homogeneous fiber orientation;

b) rotating a plurality of predetermined prepreg segments within the patterned panel so that the direction of dominant homogeneous fiber orientation in the selected plurality of prepreg segments is aligned to be substantially parallel to the at least one dominant scoop fiber orientation when the panel is subsequently formed into a wedge kit;

c) cutting the patterned panel to yield a plurality of wedge kit segments; and d) forming at least one wedge kit from the plurality of wedge kit segments.

8. The method of claim 7 wherein the step of patterning a panel adapted to be formed into a wedge kit further comprises the steps of:

a) patterning a layup pattern onto the panel; and b) segmenting the layup pattern into a plurality of body segments, a plurality of rear bourrelet segments, and a plurality of front scoop segments.

9. The method of claim 8 wherein the step of patterning includes the step of rotating the front scoop segments by at least 45 degrees with respect to the direction of dominant homogeneous fiber orientation.

10. The method of claim 8 wherein the step of patterning includes the step of rotating the front scoop segments by at least 60 degrees with respect to the direction of dominant homogeneous fiber orientation.

11. The method of claim 8 wherein the step of patterning includes the step of rotating the front scoop segments by a predetermined angle with respect to the direction of dominant homogeneous fiber orientation.

12. The method of claim 8 wherein the step of patterning further comprises the steps of:

a) marking a plurality of circular weld points onto the panel to fix the prepreg segments after being cut from the layup;

b) marking a plurality of rectangular weld points onto the panel to fix the prepreg segments after being cut from the layup;

c) marking a plurality of triangular indexing points onto the panel for identifying right prepreg segments; and d) marking a plurality of square indexing points onto the panel for identifying left prepreg segments.

13. A composite sabot wedge kit simplified tailored architecture adapted to form a composite sabot, wherein the composite sabot includes at least one dominant scoop fiber orientation, the composite sabot wedge kit comprising:

a) means for patterning a panel adapted to be formed into a wedge kit, the panel having a plurality of plies of prepreg materials oriented in a plurality of different directions, wherein one of the plurality of different directions includes the direction of dominant homogeneous fiber orientation;

b) means for rotating a plurality of predetermined prepreg segments within the patterned panel so that the direction of dominant homogeneous fiber orientation in the selected plurality of prepreg segments is aligned to be substantially parallel to the at least one dominant scoop fiber orientation when the panel is subsequently formed into a wedge kit;

c) means for cutting the patterned panel to yield a plurality of wedge kit segments; and d) means for forming at least one wedge kit from the plurality of wedge kit segments.

14. The composite sabot wedge kit of claim 13 wherein the means for patterning a panel adapted to be formed into a wedge kit further comprises:

a) means for patterning a layup pattern onto the panel; and b) means for segmenting the layup pattern into a plurality of body segments, a plurality of rear bourrelet segments, and a plurality of front scoop segments.

15. The composite sabot wedge kit of claim 13 wherein the means for patterning includes means for rotating the front scoop segments by at least 45 degrees with respect to the direction of dominant homogeneous fiber orientation.

16. The composite sabot wedge kit of claim 15 wherein the means for rotating includes means for rotating the front scoop segments by at least 60 degrees with respect to the direction of dominant homogeneous fiber orientation.

17. The composite sabot wedge kit of claim 13 wherein the means for rotating includes means for rotating the front scoop segments with respect to the direction of dominant homogeneous fiber orientation.

18. The composite sabot wedge kit of claim 13 wherein the means for patterning further comprises means for impressing a plurality of indicia on the prepreg segments.

19. The simplified tailored composite architecture of claim 1 wherein the panel comprises a plurality of plies of different fiber orientations.

20. The simplified tailored composite architecture of claim 1 wherein the panel comprises a continuous fiber prepreg material.

21. The simplified tailored composite architecture of claim 1 wherein the continuous fiber prepreg material is selected from the group consisting of a continuous fiber/epoxy system, a thermoset fiber/epoxy system, a thermoplastic fiber/epoxy system, a continuous thermoset fiber/epoxy system, a continuous thermoplastic fiber/epoxy system, a thermoplastic fiber/resin system, a continuous thermoset fiber/resin system, and a continuous thermoplastic fiber/resin system.

* * * * *

UNITED STATES PATENT AND TRADEMARK OFFICE

CERTIFICATE OF CORRECTION

PATENT NO. : 6,125,764
DATED : October 3, 2000
INVENTOR(S) : Kamdar

It is certified that error appears in the above-identified patent and that said Letters Patent is hereby corrected as shown below:

Title page,
Please change the Assignee from "Alliant Tech Systems Inc.," to -- Alliant Techsystems Inc. --.

Column 1,
Line 11, please change the phrase "to a to" to -- to a --.

Signed and Sealed this

Twenty-ninth Day of January, 2002

*Attest:*

*Attesting Officer*

JAMES E. ROGAN
*Director of the United States Patent and Trademark Office*